US008997517B2

(12) United States Patent
Bertolini et al.

(10) Patent No.: US 8,997,517 B2
(45) Date of Patent: Apr. 7, 2015

(54) CONTROLLED TEMPERATURE COMPARTMENT FOR REFRIGERATOR

(75) Inventors: Nilton Carlos Bertolini, Chonburi (TH); Edmund S. Richardson, Simpsonville, SC (US); Jerry R. Baack, Anderson, SC (US); David L. Hall, Piedmont, SC (US); Cory Dale Simpson, Abbeville, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 1328 days.

(21) Appl. No.: 12/394,189

(22) Filed: Feb. 27, 2009

(65) Prior Publication Data

US 2010/0218514 A1 Sep. 2, 2010

(51) Int. Cl.

| | |
|---|---|
| ***F25D 11/02*** | (2006.01) |
| ***F25D 25/02*** | (2006.01) |
| ***F25D 17/06*** | (2006.01) |

(52) U.S. Cl.

CPC ..... *F25D 25/025* (2013.01); *F25D 17/065* (2013.01); *F25D 2317/061* (2013.01); *F25D 2317/067* (2013.01); *F25D 2323/021* (2013.01); *F25D 2325/022* (2013.01); *F25D 2400/02* (2013.01); *F25D 2400/361* (2013.01); *F25D 2700/121* (2013.01)

(58) Field of Classification Search

CPC F25D 17/065; F25D 17/062; F25D 2317/061
USPC ..... 62/441, 408, 407, 449, 450, 56, 187; 312/404, 408, 402, 348.3
See application file for complete search history.

(56) References Cited

U.S. PATENT DOCUMENTS

| | | | |
|---|---|---|---|
| 4,732,014 | A | 3/1988 | Frohbieter |
| 5,326,578 | A | 7/1994 | Yun |
| 5,896,748 | A | 4/1999 | Park |
| 5,899,083 | A | 5/1999 | Peterson et al. |

(Continued)

FOREIGN PATENT DOCUMENTS

| | | |
|---|---|---|
| CN | 2881468 | 3/2007 |
| CN | 101358794 | 2/2009 |

(Continued)

OTHER PUBLICATIONS

Partial International Search Report for PCT/US2010/025026 dated Jan. 20, 2011, 2 pages.

*Primary Examiner* — Cheryl J Tyler
*Assistant Examiner* — Melanie Phero
(74) *Attorney, Agent, or Firm* — Pearne & Gordon LLP

(57) ABSTRACT

A storage compartment assembly is located within the interior of a compartment of a refrigerator such as a fresh food compartment of a refrigerator. The storage compartment assembly includes a storage container the temperature of which can be controlled independently of the temperature in the fresh food compartment. At least one of the sides of the storage container can be spaced away from a respective interior side of the refrigerator compartment and a housing located in the space between the side of the storage container and the interior side of the refrigerator compartment. The housing can contain components that are configured to function in the operation of the refrigerator, including the storage compartment assembly. The refrigerator can comprise a bottom-mount refrigerator and the fresh food compartment can be provided with double-doors for closing and opening the interior of the fresh food compartment.

49 Claims, 3 Drawing Sheets

(56) References Cited

U.S. PATENT DOCUMENTS

| | | | | |
|---|---|---|---|---|
| 6,170,276 | B1 | 1/2001 | Mandel et al. | |
| 6,176,097 | B1 | 1/2001 | Kim | |
| 6,223,553 | B1 | 5/2001 | Albert et al. | |
| 6,343,477 | B1 | 2/2002 | Mandel et al. | |
| 6,405,548 | B1 | 6/2002 | Hollenbeck | |
| 6,418,739 | B2 | 7/2002 | Cho et al. | |
| 6,463,752 | B2 | 10/2002 | Mandel et al. | |
| 6,612,116 | B2 | 9/2003 | Fu et al. | |
| 6,655,169 | B2 | 12/2003 | Tupis et al. | |
| 6,675,603 | B1 | 1/2004 | Lesyna et al. | |
| 6,684,656 | B2 | 2/2004 | Gray et al. | |
| 6,694,761 | B2 | 2/2004 | Cho et al. | |
| 6,725,678 | B2 | 4/2004 | Chang et al. | |
| 6,725,680 | B1 | 4/2004 | Schenk et al. | |
| 6,782,706 | B2 | 8/2004 | Holmes et al. | |
| 6,802,186 | B2 | 10/2004 | Holmes et al. | |
| 6,802,369 | B2 | 10/2004 | Zentner et al. | |
| 6,880,949 | B2 | 4/2005 | Miozza et al. | |
| 7,032,407 | B2 | 4/2006 | Chastine | |
| 7,036,334 | B2 | 5/2006 | Ko et al. | |
| 7,051,549 | B2 | 5/2006 | Kim et al. | |
| 7,096,936 | B1 | 8/2006 | Chastine et al. | |
| 7,100,387 | B2 | 9/2006 | Boer et al. | |
| 7,188,479 | B2 | 3/2007 | Anselmino et al. | |
| 7,299,644 | B2 | 11/2007 | Athanasiou et al. | |
| 7,971,443 | B2 * | 7/2011 | Nishita et al. | 62/159 |
| 8,015,839 | B2 * | 9/2011 | Kang et al. | 62/408 |
| 8,074,469 | B2 * | 12/2011 | Hamel et al. | 62/441 |
| 8,132,423 | B2 * | 3/2012 | Tikhonov et al. | 62/340 |
| 8,220,286 | B2 * | 7/2012 | Cushman et al. | 62/407 |
| 2005/0056045 | A1 * | 3/2005 | Schmid et al. | 62/407 |
| 2006/0266068 | A1 * | 11/2006 | Wetekamp et al. | 62/340 |
| 2008/0016899 | A1 | 1/2008 | Anselmino et al. | |
| 2008/0302125 | A1 * | 12/2008 | Cushman et al. | 62/408 |

FOREIGN PATENT DOCUMENTS

| | | | |
|---|---|---|---|
| JP | 4244569 | A | 9/1992 |
| JP | 5187756 | A | 7/1993 |
| JP | 611231 | A | 1/1994 |
| JP | 6213547 | A | 8/1994 |
| WO | 2007105902 | | 9/2007 |
| WO | 2008130109 | | 10/2008 |

* cited by examiner

FIG. 2
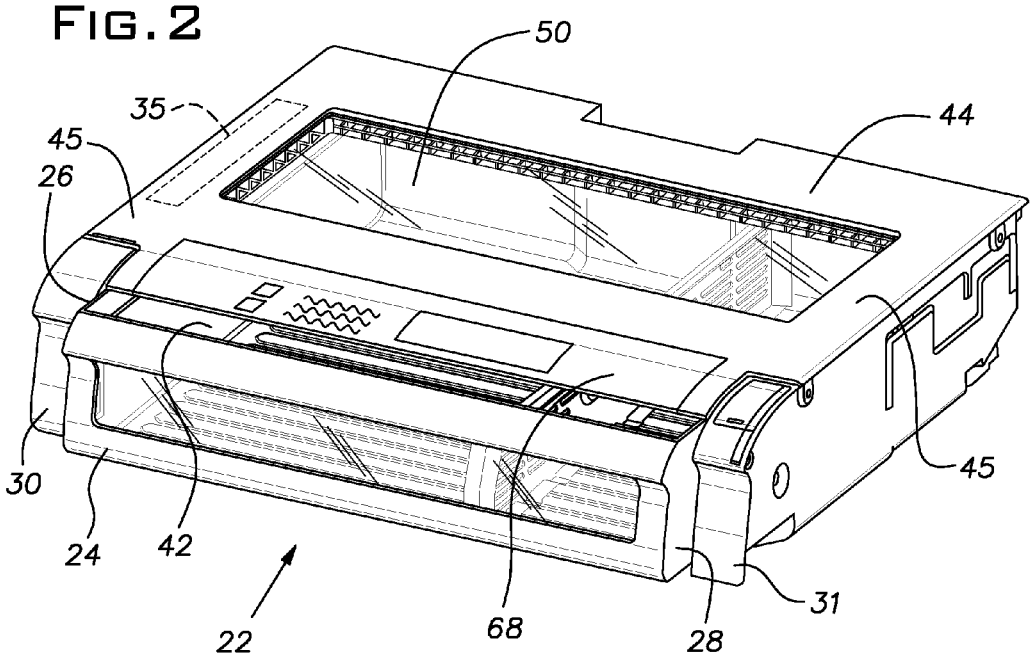
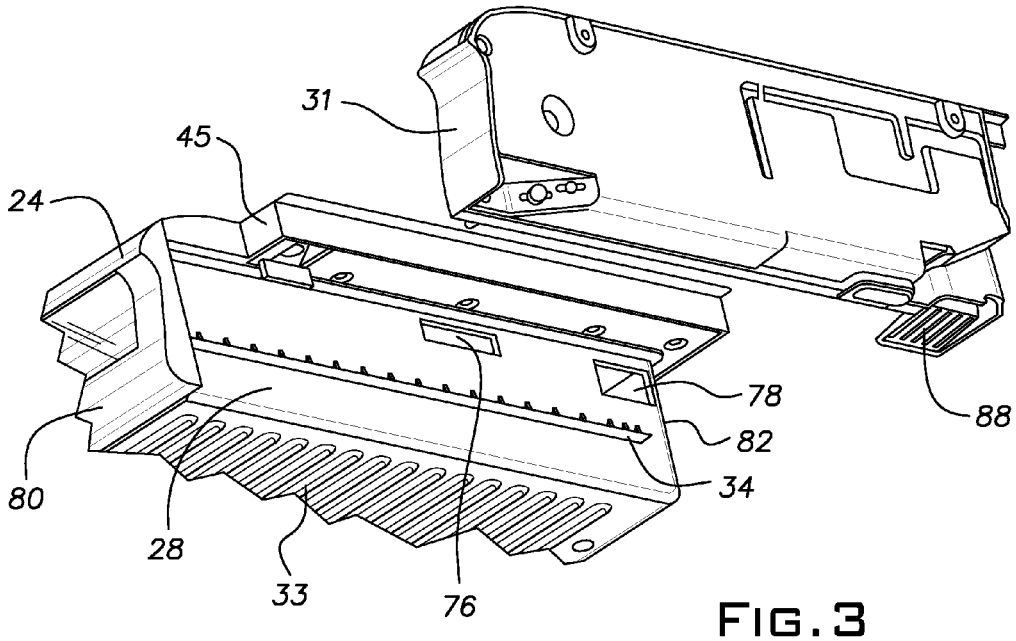
FIG. 3

FIG. 4
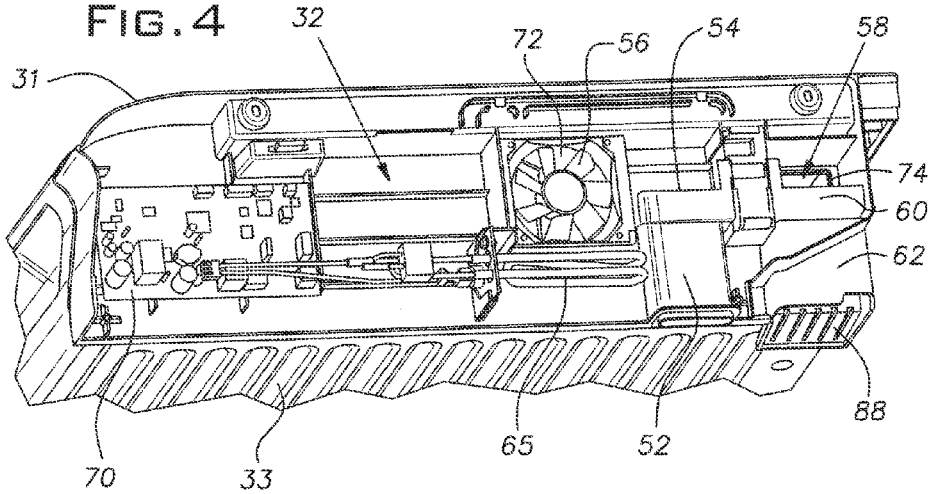
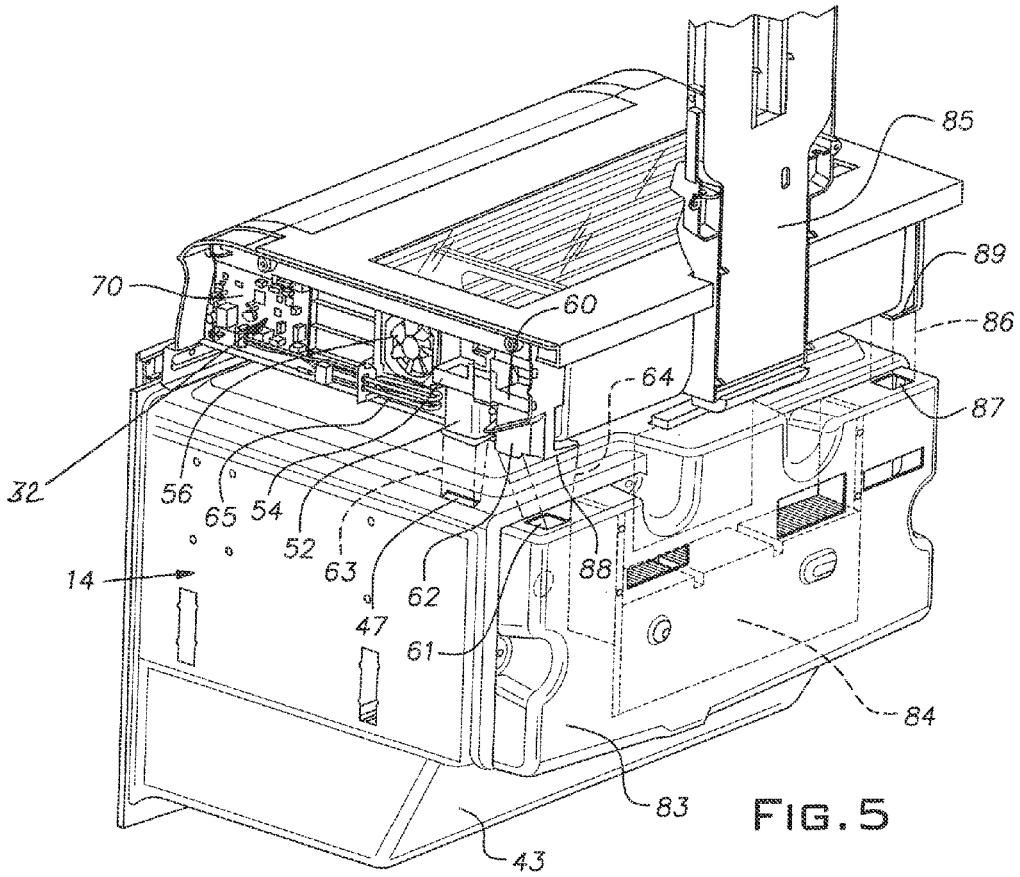
FIG. 5

CONTROLLED TEMPERATURE COMPARTMENT FOR REFRIGERATOR

BACKGROUND OF THE INVENTION

The present invention generally concerns storage compartment assemblies or units for storing articles in cooling equipment such as refrigerators. In a particular aspect, the present invention concerns, for example, temperature-controlled storage compartment assemblies for storing articles in compartments such as fresh food compartments of household refrigerators including so-called bottom-mount refrigerators in which the fresh food compartments, which can be provided with double doors, are located on top of the refrigerators' freezer compartments.

Storage compartment assemblies for cooling equipment can be located within, and selectively operated at least somewhat independently of, larger compartments of the cooling equipment in which the storage compartment assemblies are located. For example, storage compartment assemblies for separately chilling liquids can be located within the freezer compartments and fresh food compartments of household refrigerators. Also, storage compartment assemblies that function and are configured to control the moisture and/or oxygen levels within storage containers that are included in the assemblies, or control the temperatures within the storage containers, for example, can be located within the fresh food compartments of refrigerators. In this latter respect, the storage compartment assemblies can, for example, be configured and function to quickly cool or thaw articles placed within the storage containers included in the storage compartment assemblies.

The types of refrigerators in which storage compartment assemblies as described in the immediately preceding paragraph can be provided include, for example: side-by-side refrigerators, in which the fresh food and freezer compartments are arranged side-by-side; bottom-mount refrigerators in which the freezer compartments are located beneath the fresh food compartments; and top-mount refrigerators in which the fresh food compartments are located beneath the freezer compartments. The storage compartment assemblies can be located in the fresh food compartments as well as in the freezer compartments. In addition, the storage compartment assemblies can be configured to comprise units that are installed in the refrigerators separate from the fresh food and freezer compartments either alone or along with other kinds of special-purpose storage compartments.

SUMMARY OF THE INVENTION

The following is a simplified summary of the invention and does not represent a comprehensive exposition of all aspects of the invention. Moreover, the summary is not intended to identify critical elements nor delineate the scope of the invention. The purpose of the summary is to present certain aspects related to the invention as a prelude to the more detailed description of embodiments of the invention that follows thereafter.

According to one aspect, a refrigerator includes a refrigerator compartment that includes an interior and opposing first and second interior sides. A storage compartment assembly located within the interior of the refrigerator compartment between the opposing sides of the refrigerator compartment includes a storage container that is configured for withdrawal from between the opposing sides of the interior of the refrigerator compartment, while being supported at least in part from the interior of the refrigerator compartment, and reentry to the interior of the refrigerator compartment after having been withdrawn. The storage container includes a first side that is located opposite the first interior side of the refrigerator compartment and a second side that is located opposite the second interior side of the refrigerator compartment. At least one of the first side and second side of the storage container is spaced away from the first interior side and the second interior side of the refrigerator compartment, respectively A housing is located between either the first interior side of the refrigerator compartment and the first side of the storage container or between the second interior side of the refrigerator compartment and the second side of the storage container. In such an aspect, the refrigerator can include a door for opening and closing the interior of the refrigerator compartment to the exterior of the refrigerator compartment, and the door can be pivotally mounted at the same side of the refrigerator compartment at which the housing is located.

According to another aspect, the refrigerator includes two housings. A first housing is located between the first interior side of the refrigerator compartment and the first side of the storage container and a second housing is located between the second interior side of the refrigerator compartment and the second side of the storage container. In this aspect, the refrigerator can include two doors that are configured to open and close off the interior of the refrigerator compartment to the exterior of the fresh food compartment. Each door would include a first side and a second side opposite the first side. The first side of each door would be pivotally mounted at a respective side of the refrigerator compartment and the second side of each door would adjoin the second side of the other door when the doors are in a position closing off the interior of the refrigerator compartment.

According to a further aspect, at least one housing can contain at least components that are configured to function in the operation of the refrigerator, and, in a particular representation thereof, the components are configured to function in the operation of the storage compartment assembly. These latter components can comprise components that are configured to function in controlling the movement of air through the storage container of the storage compartment assembly, including the movement of air having a temperature that ranges from a temperature below the temperature of the refrigerator compartment to a temperature above the temperature of the refrigerator compartment. And in an aspect in which first and second housings are provided, the other of the housings can contain at least components that are configured to function in filtering water dispensed at the refrigerator.

According to an additional aspect, one housing can comprise an air handler that includes at least components that are configured to function in controlling the movement of air through the storage container of the storage compartment assembly over the range of temperatures. In this regard, the air handler would include a cold air pathway that is configured to selectively provide air flow communication from a source of cold air to the storage container and a return air pathway that is configured to selectively provide air flow communication from the storage container to the source of cold air. Also, the air handler can include a first air flow controlling device that is configured to selectively open and close off air flow communication from the source of cold air to the storage container along the cold air pathway and a second air flow controlling device that is configured to selectively open and close off air flow communication from the storage container to the source of cold air along the return air pathway. Further, the air handler can include an air mover, such as a fan, that is configured to at least assist in moving air through the air handler and the storage container. The fan can be located in the cold air pathway.

According to yet another aspect, the first air flow controlling device and the second air flow controlling device can be configured to selectively simultaneously open air flow communication from the source of cold air to the storage container along the cold air pathway and air flow communication from the storage container to the source of cold air along the return air pathway, respectively. And the first and second air flow controlling devices can be configured to selectively simultaneously close off air flow communication from the source of cold air to the storage container along the cold air pathway and air flow communication from the storage container to the source of cold air along the return air pathway, respectively.

According to yet a further aspect, the first air flow controlling device and the second air flow controlling device can be configured to selectively simultaneously close off air flow communication from the source of cold air to the storage container along the cold air pathway and open air flow communication from the storage container to the source of cold air along the return air pathway, respectively.

According to still another aspect, the air handler can include as a component a heater configured to selectively increase the temperature of air moving from the air handler to the storage container. In a particular aspect, the heater can be configured to be energized when the first air flow controlling device and the second air flow controlling device selectively simultaneously close off air flow communication from the source of cold air to the storage container along the cold air pathway and air flow communication from the storage container to the source of cold air along the return air pathway, respectively.

According to yet an additional aspect, the storage container can include an open top and the storage compartment assembly can include a cover that covers over the open top of the storage container when the storage container is in place within the refrigerator compartment. A user input panel can be mounted at the cover. The user input panel can be configured to accept user inputs and be operatively connected to an electronic control device that is configured to control, in response to the user inputs, the operation of at least the components of the air handler that are configured to function in controlling the movement of air through the storage container. In a particular representation of this aspect, the electronic control device can comprise an electronic control board that can be located in the air handler.

According to further aspects, the refrigerator compartment can comprise a fresh food compartment and the refrigerator can include a freezer compartment and an evaporator that are located beneath the fresh food compartment, the evaporator comprising the source of cold air.

According to still an additional aspect, the refrigerator can include a fresh food compartment air delivery pathway that is configured to deliver cold air from the evaporator to the fresh food compartment and a first fresh food compartment air return pathway for returning air from the fresh food compartment to the evaporator. Additionally, the refrigerator can include a second fresh food compartment air return pathway for returning air from the fresh food compartment to the evaporator. The second fresh food compartment air return pathway can join with the return air pathway that is configured to selectively provide air flow communication from the storage container to the evaporator.

According to another aspect, the storage compartment assembly can include a first air flow path that leads from within the air handler through an air exit point at the air handler to an air entry point at the storage container. A second air flow path can lead from the source of cold air to the air handler and be joined with the first air flow path. A third air flow path can lead from an air exit point at the storage container through an air entry point at the air handler to within the air handler. A fourth air flow path can lead from within the air handler to the source of cold air and be joined to the third air flow path. The first air flow controlling device can be configured to selectively open and close the flow of air between the first flow path and the second flow path. And the second air flow controlling device can be configured to selectively open and close the flow of air between the third flow path and the fourth flow path. In a particular aspect, the storage compartment assembly can further include a fifth air flow path that joins the first air flow path and the third air flow path.

According to a further aspect, the first air flow controlling device and the second air flow controlling device can be configured to be selectively open at the same time to allow air from the source of cold air to flow to the storage container along the first and second air flow paths and, after circulating in the storage container, to flow back to the source of cold air along the third and fourth air flow paths. The first and second air flow controlling devices also can be configured to be closed at the same time so as to close off the flow of air from the source of cold air to the storage container along the first and second air flow paths and the flow of air from the storage container to the source of cold air along the third and fourth air flow paths, whereby air can flow from the air exit point at the storage container to the air entry point at the storage container along the third, fifth and second air flow paths. Further, the first airflow controlling device and the second air flow controlling device can be configured such that the first air flow controlling device is selectively closed so as to close off the flow of air from the source of cold air to the storage container along the first and second air flow paths at the same time as the second air flow controlling device is selectively open to allow air from the storage container to flow to the source of cold air along the third and fourth air flow paths.

According to additional aspects, the fan can be located adjacent the air exit point at the air handler and the heater can be located adjacent to the fan and the first air flow path and below the fan.

According to yet another aspect, a method of controlling the temperature in the storage container when located in the fresh food compartment of a refrigerator includes selecting a temperature to be applied at the storage container and comparing the selected temperature with the prevailing temperature in the storage container. When the selected temperature is lower than the prevailing temperature, air having a lower temperature than the prevailing temperature is delivered to the storage container from where the air is exhausted. When the selected temperature is higher than the prevailing temperature, air having a higher temperature than the prevailing temperature is delivered to the storage container from where the air is exhausted. In a particular aspect, air having a lower temperature than the prevailing temperature can be delivered to the storage container from the evaporator of the refrigerator during which time air exhausted from the storage container can be directed to the evaporator. The air having a lower temperature can be delivered to the storage container through a first air flow controlling device that is maintained in an open position while the air that is exhausted from the storage container can be directed to the evaporator through a second air flow controlling device that is maintained in an open position.

According to still another aspect, at such time as air having a higher temperature that the prevailing temperature in the storage chamber is being delivered to the storage chamber, the first and second air flow controlling devices can be maintained in closed positions to close off the flow of air from the evaporator to the storage chamber and from the storage chamber to the evaporator, respectively.

According to still a further aspect, the method of controlling the temperature in a storage container located in the fresh food compartment of a refrigerator that includes selecting a temperature to be applied at the storage container and comparing the selected temperature with the prevailing temperature in the storage container can comprise, in response to the comparison of temperatures, carrying out an appropriate operation from a group of at least the three following available operations for applying the selected temperature in the storage container: delivering to the storage container air having a lower temperature than the prevailing temperature when the selected temperature is lower than the prevailing temperature while exhausting from the storage container air that has circulated in the storage container; delivering to the storage container air having a higher temperature than the prevailing temperature when the selected temperature is higher than the prevailing temperature while exhausting from the storage container air that has circulated in the storage container; and maintaining the storage container at substantially the same temperature as the temperature of the fresh food compartment while allowing air from the storage container to exit the storage container.

According to an additional aspect: the operation of delivering to the storage container air having a lower temperature than the prevailing temperature can include delivering air to the storage container from a evaporator of the refrigerator through a first air flow controlling device that is maintained in an open position and exhausting air from the storage container to the evaporator through a second air flow controlling device that is maintained in an open position; the operation of delivering to the storage container air having a higher temperature than the prevailing temperature can include delivering air to the storage container while maintaining the first air flow controlling device in a closed position so as to close off the flow of air from the evaporator to the storage container and exhausting air from the storage container while maintaining the second air flow controlling device in a closed position so as to close off the flow of air from the storage container to the evaporator; and the operation of maintaining the storage container air at the same temperature as the temperature of the fresh food compartment can include maintaining the first air flow controlling device in a closed position so as to close off the flow of air from the evaporator to the storage container and allowing air that exits the storage container to pass to the evaporator through the second air flow controlling device that is maintained in an open position.

According to yet an additional aspect, the operation of delivering to the storage container air having a higher temperature than the prevailing temperature can include increasing the heat content of the air before it is delivered to the storage container.

According to still another aspect, the operation of delivering to the storage container air having a lower temperature than the prevailing temperature in the storage container can involve comparing the average of the prevailing temperature in the storage container based on three temperature readings taken at approximately ten-second intervals with the selected temperature.

According to yet another aspect, the operation of delivering to the storage container air having a higher temperature than the prevailing temperature in the storage container can involve comparing the prevailing temperature in the storage container with the selected temperature approximately every two seconds.

According to still an additional aspect, air can be exhausted to the evaporator from the fresh food compartment at substantially the same location in the evaporator as air from the storage compartment is exhausted.

BRIEF DESCRIPTION OF THE DRAWINGS

In the drawings:

FIG. 2 is a perspective view of an embodiment of the storage compartment assembly of the invention;

FIG. 3 is an exploded, partial perspective view of the embodiment of the storage compartment assembly of FIG. 2;

FIG. 4 is a partial perspective view of the embodiment of the storage compartment assembly of FIG. 2 with an outer panel removed for the purpose of illustrating certain internal components of the assembly;

FIG. 5 is a perspective view of certain components of the embodiment of FIG. 1 including the storage compartment assembly, having an outer panel removed for the purpose of illustrating certain internal components of the assembly, together with the freezer and evaporator compartments;

DETAILED DESCRIPTION OF EMBODIMENTS OF THE INVENTION

Figure 1:
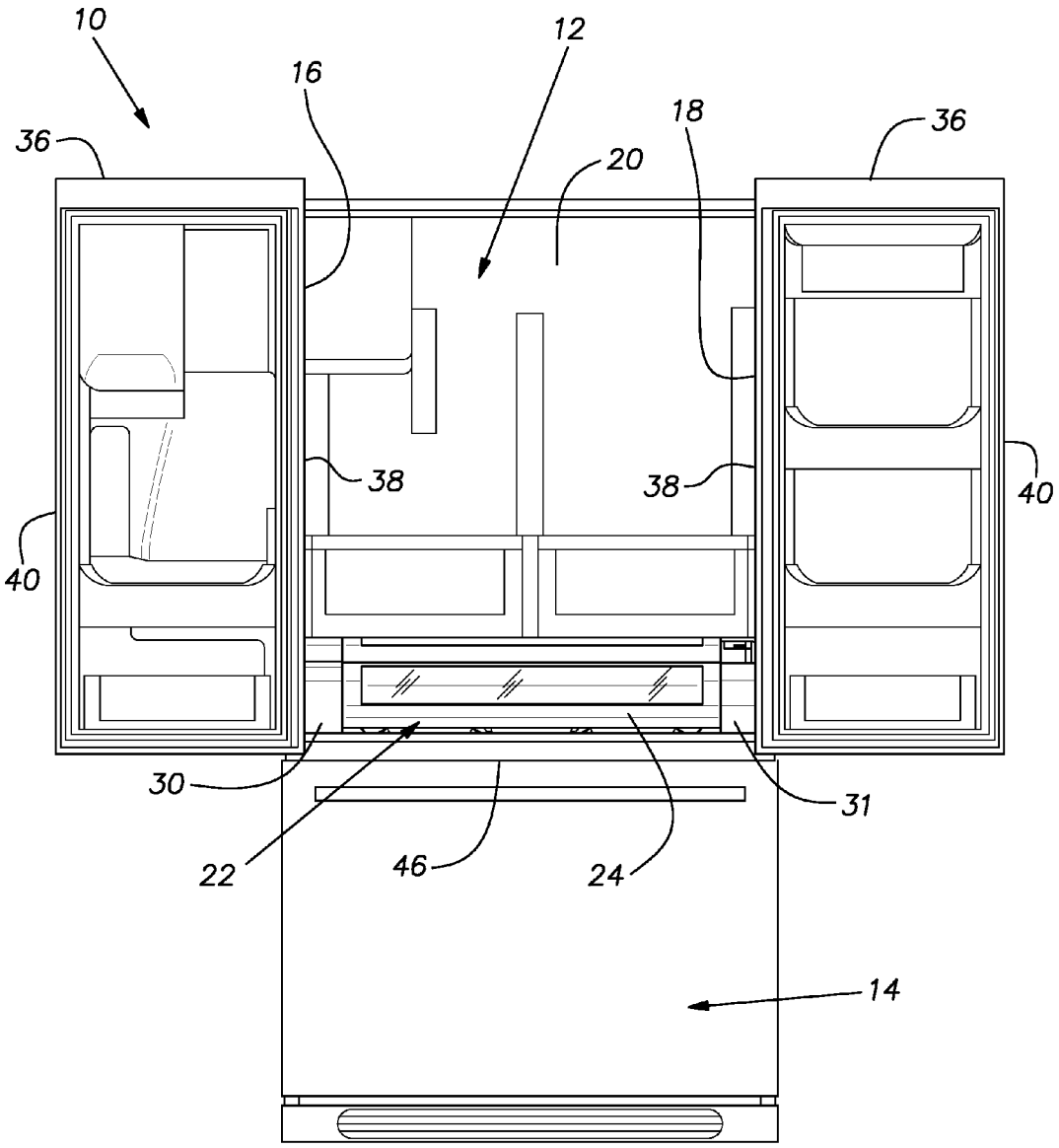
FIG. 1 is a front elevational view of an embodiment of the invention comprising a bottom-mount refrigerator, including double doors provided at the fresh food compartment of the refrigerator, and a storage compartment assembly located in the fresh food compartment.

The embodiment of the invention that is shown in FIG. 1 of the drawings comprises a refrigerator, indicated generally at 10, that includes two refrigerator compartments indicated generally at 12 and 14, respectively. In the embodiment of FIG. 1, the refrigerator compartment 12 comprises a fresh food, or refrigerating, compartment in which articles can be stored at temperatures above their freezing points but low enough to maintain the articles in a usable condition for reasonable periods of time. Refrigerator compartment 14 in the embodiment of FIG. 1, which is located beneath the refrigerator compartment 12, comprises a freezer compartment in which articles can be stored at below their freezing points for extended periods of time. Refrigerators in which the freezer compartments are located beneath the fresh food compartments are sometimes referred to in the art as "bottom-mount" refrigerators.

The fresh food compartment 12 includes an interior 20 and opposing first and second interior sides 16 and 18. Although not depicted in detail in FIG. 1, the interior 20 of the fresh food compartment would include shelves and/or drawers as is typical for the fresh food compartments of refrigerators. In addition, a storage compartment assembly, indicated generally at 22 and shown in higher detail in FIGS. 2 through 5, is located within the interior 20 of the compartment 12 between the opposing interior sides 16 and 18 of the compartment 12 and adjacent the bottom of the compartment. While the storage compartment assembly 22 is shown in the drawings as located in a fresh food compartment of a refrigerator, the assembly can be located in a refrigerator compartment other than a fresh food compartment. For example, the storage compartment assembly can be located in a freezer compartment of a refrigerator or in a refrigerator compartment which contains only the storage compartment assembly or contains the assembly together with one or more special purpose compartments. Additionally, the storage compartment assembly can be located in types of refrigerators other than bottom-mount refrigerators. For example, the storage compartment assembly can be located in refrigerators in which the fresh food and freezer compartments are arranged side-by-side or in which the freezer compartments are positioned above the fresh food compartment.

The storage compartment assembly 22 includes a storage container 24 which is mounted within, or at the interior of, the fresh food compartment 12 and is configured to store articles within its confines. As seen in FIG. 2, the storage container includes a first side 26 and a second side 28. The first side 26 of the storage container 24 is located opposite the first interior side 16 of the refrigerator compartment 12 and the second side 28 of the storage container 24 is located opposite the second interior side 18 of the refrigerator compartment 12. At least one of the first side 26 and second side 28 of the storage container 24 is spaced away from the first interior side 16 and second interior side 18 of the refrigerator compartment 12, respectively; and a housing is located between the at least one of the first side and second side of the storage container 24 that is spaced away from the first interior side and the second interior side of the refrigerator compartment 12, respectively. Thus, for example, space can be provided only between the first interior side 16 of the fresh food compartment interior 20 and the first side 26 of the storage container 24 or only between the second interior side 18 of the fresh food compartment interior and the second side 28 of the storage container and a housing installed in that space. Alternatively, for example, spaces can be provided between the first interior side 16 of the fresh food compartment interior 20 and the first side 26 of the storage container 24, as well as between the second interior side 18 of the fresh food compartment interior and the second side 28 of the storage container, and a housing installed in only one of the spaces. As an additional alternative, housings can be installed at both spaces as in the embodiment of the invention illustrated in the drawings in which a first housing 30 is located between the first interior side 16 of the fresh food compartment interior 20 and the first side 26 of the storage container 24 and a second housing 31 is located between the second interior side 18 of the refrigerator compartment interior 20 and the second side 28 of the storage container 24.

The storage container 24 is configured for withdrawal from between the opposing interior sides 16 and 18 of the interior 20 of the refrigerator compartment 12 for the complete removal of the storage container from the refrigerator compartment, if desired, or for the partial removal of the storage container so that articles can be placed into or removed from within the storage container, for example. When withdrawn, the storage container 24 is supported at least in part from the interior of the refrigerator compartment 12. The storage container 24 also is configured for reentry to the interior 20 of the refrigerator compartment after having been withdrawn. Thus, for example, sliding or guide rails of rail systems can be mounted to the first side 26 and second side 28 of the storage container 24 and complementary slide or guide rails mounted to respective adjacent sides of the housings 30 and 31, whereby the storage container can be withdrawn from and returned to the interior of the compartment 12 along the rails, and, when withdrawn, supported from the interior 20 of the refrigerator compartment by the rail systems. The manner in which such rail systems can be installed at the sides of the storage container and at the sides of the housings 30 and 31 is familiar to those having ordinary skill in the art and, consequently, is not shown in the drawings or described in detail herein. However, as shown in FIG. 3, reference numeral 34 indicates a location on the second side 28 of the storage container 24 where a rail of such a rail system can be installed. Alternatively, as will be understood by those having ordinary skill in the art, appropriate complementary rolling or sliding guides or rails can be located at the outside bottom surface 33 of the storage container 24 and the bottom inside surface of the fresh food compartment 12 along which the storage container can be suitably mounted for the withdrawal from and return to the interior 20 of the fresh food compartment as desired.

Whether a housing is provided at each side 26 and 28 of the storage container 24 as shown in the drawings or only one housing is provided at one side of the storage container, one or more of the housings can contain at least components that are configured to function in the operation of the refrigerator 10. And the components that are configured to function in the operation of the refrigerator can comprise components that are configured to function in the operation of the storage compartment assembly 22. In particular, the components that are configured to function in the operation of the storage compartment assembly 22 can comprise components that are configured to function in controlling the movement of air through the storage container 24; and these components can comprise components that are configured to function in controlling the movement of air through the storage container 24 at air temperatures that range from a temperature below the temperature of the refrigerator compartment 12 to a temperature above the temperature of the refrigerator compartment. For example, one or more of the housings can contain ductwork, fans, dampers, electric or electronic elements or components of air-filtering or water-filtering equipment. Specifically, when two housings are in place, as shown in the drawings, one of the first housing 30 and second housing 31 can contain at least components that are configured to function in controlling the movement of air through the storage container 24 at air temperatures ranging from below the temperature of the refrigerator compartment to above the temperature of the refrigerator compartment; and the other of the first housing and the second housing can contain at least components that are configured to function in filtering water dispensed at the refrigerator.

Locating one or more of the sides 26 and 28 of the storage container 24 away from respective interior sides 16 and 18 of the fresh food compartment 12 provides a space between respective sides of the fresh food compartment and the storage container 24 that advantageously furnishes a location for housings, such as housings 30 and 31, to be installed and in which components that function in the operation of the refrigerator can be housed if desired. Such an arrangement also reduces the likelihood that the sides of the storage container 24, when the storage container is withdrawn from the interior of the fresh food compartment, will collide with a door for opening and closing the interior of the fresh food compartment to the exterior of the fresh food compartment. This is particularly so in the case in which the door is pivotally mounted at the same side of the refrigerator compartment at which the housing is located.

In the embodiment of the invention illustrated in the drawings, two doors 36, in the nature of French-style, or double, doors are provided at the fresh food compartment 12 rather than a single door. These two doors are configured to open and close off the interior 20 of the fresh food compartment to the exterior of the fresh food compartment. Each door includes a first side 38 and a second side 40 opposite the first side. The first side 38 of each door is pivotally mounted at a respective side of the fresh food compartment 12, in a manner familiar to those having ordinary skill in the art, and the second side of each door adjoins the second side of the other door when the doors are in a position closing off the interior of the fresh food compartment. In such an arrangement, the fact that the sides of the storage container 24 are spaced from the sides of the interior 20 of the fresh food compartment 12 to accommodate the housings 30 and 31 reduces the likelihood that the sides of the storage container will collide with the first sides 38 of the doors or the shelves and other refrigerator components that are located at the inside surfaces of the doors when the storage container is withdrawn from the interior of the fresh food compartment. A similar benefit exits when the fresh food compartment is provided with a single door, and the side of the storage container that is located on the same side of the refrigerator as the side of the refrigerator where the door is pivotally mounted is spaced away from the adjacent interior side of the fresh food compartment.

As shown in FIG. 2, in which the storage container 24 is shown slightly ajar with respect to the housings 30 and 32, the storage container includes an open top 42 for providing access to the interior of the storage container. The storage compartment assembly 22 also includes a cover 44 as shown in FIG. 2 that covers over the open top 42 of the storage container 24 when the storage container is in place within the refrigerator compartment 12. In this connection, as shown in FIGS. 2 and 3, the cover extends over and is supported on respective ones of the housings 30 and 31 by a cover extension 45 provided at each side of the cover 44. The cover 44 can include an upper panel and a lower panel that are held together such as by gluing the panels together. Both panels include centrally-located openings in which are located two spaced-apart panes 50 of refrigerator glass or the like. The margins of the panes of refrigerator glass are sandwiched between the upper panel and the lower panel of the cover. The storage container 24, when it is in place beneath the cover 44, can either be sealed at the cover or there can be somewhat of a gap between the top perimeter edge of the storage container and the bottom of the cover 44 through which air is free to pass to and from the inside of the storage container from and to, respectively, the fresh food compartment 12.

As shown in FIG. 1, the two refrigerator compartments 12 and 14 are separated by a mullion 46 that comprises, essentially, an insulation panel between the two compartments. The storage compartment assembly 22 is located adjacent the bottom of the compartment 12 near the top of the mullion 46. In FIG. 5, the storage compartment assembly 22 and the freezer compartment 14 are shown in their relative positions outside the confines of the refrigerator cabinet. However, the insulating mullion 46 is not shown as being in place. Rather, the storage compartment assembly 22 and the freezer compartment 14 are shown as separated by an open space in which the mullion would be located in the assembled refrigerator. Although the insulating mullion 46 is not shown in FIG. 5, ducts 63, 64 and 86 that are contained, at least partly, within the insulating mullion are shown in phantom lines for the purpose of facilitating the further description of the embodiment of the invention that is shown in the drawings.

FIG. 5 also illustrates certain aspects of the freezer compartment 14. As shown there, the freezer compartment has a sloped configuration at its lower rear portion 43 and components of the refrigerating system for the refrigerator 10, such as the compressor and condenser, for example, are located at the rear of the sloped portion 43 of the freezer compartment and beneath a housing 83 that is attached to the upper rear portion of the freezer compartment. The evaporator 84 of the refrigerating system is located within the housing 83.

At least one of the first housing 30 and the second housing 31 comprises an air handler that includes at least components 32, as shown in FIGS. 4 and 5 for example, that are configured to function in controlling the movement of air through the storage container 24 of the storage compartment assembly 12. In the embodiment of the drawings, the housing 31 comprises the air handler which includes a cold air pathway that is configured to selectively provide air flow communication from a source of cold air (the area of the evaporator 84 in the embodiment of the drawings, for example,) to the storage container 24 and a return air pathway that is configured to selectively provide air flow communication from the storage container 24 to the source of cold air. In the description and claims, reference is made to air either coming from or going to the evaporator 84 or the area of the evaporator 84 and air flow paths either coming from or leading to the evaporator or the area of the evaporator. No distinction is intended whether reference is made to the "evaporator" or the "area of the evaporator."

In the embodiment of FIGS. 4 and 5, wherein an outer panel of the housing 31 has been removed so as to expose certain internal components and elements, indicated generally at 32, of the air handler, the cold air pathway comprises the pathway that leads from the evaporator 84 through an opening 47 in the liner of the freezer compartment 14, through a mullion cold air supply duct 63, through an air handler cold air supply duct 52, past a first air flow controlling device 54, through an air mover in the embodiment of a fan 56, for example, that is configured to at least assist in moving the air that is circulated between the air handler and the storage container 24, and into the storage container through openings in the air handler and the storage container that are located at the fan 56. Thus, one of the components of the air handler that is configured to function in controlling the movement of air through the storage container 24 includes the fan 56 which is located in the cold air pathway and is configured to at least assist in moving air from the air handler to the storage container. The return air pathway, as can be seen in FIG's. 4 and 5, comprises the pathway that leads from the storage container 24 through respective openings in the storage container and the air handler, indicated generally at 58, past a second air flow controlling device 60, through an air handler air return duct 62, through a mullion air return duct 64, through an opening 61 in the housing 83 into the area of the evaporator 84. The air handler also includes a heater 65 that is configured to selectively increase the temperature of air moving from the air handler to the storage container 24 in particular operating circumstances as further described below.

The first air flow controlling device 54 and the second air flow controlling device 60 comprise additional components of the air handler that are configured to function in controlling the movement of air through the storage container 24. The first air flow controlling device 54 is configured to selectively open and close off air flow communication from the source of cold air, or the evaporator 84, to the storage container 24 along the cold air pathway described above, and the second air flow controlling device 60 is configured to selectively open and close off air flow communication from the storage container 24 to the source of cold air along the return air pathway also described above. Both the first air flow controlling device 54 and the second air flow controlling device 60 can comprise, for example, what is known in the art as dampers. The use of dampers for controlling air flow is known to those skilled in the art so that a detailed description of such dampers is not presented here The first air flow controlling device 54 and the second air flow controlling device 60 are configured to function in at least three cooperative relationships. One, the first air flow controlling device 54 and the second air flow controlling device 60 are configured to selectively and simultaneously open air flow communication from the source of cold air, such as the area of the evaporator 84, to the storage container 24 along the cold air pathway described above and air flow communication from the storage container to the source of cold air along the return air pathway described above, respectively. Two, the first and second air flow controlling devices 54 and 60 are configured to selectively and simultaneously close off air flow communication from the source of cold air, such as the area of the evaporator 84, to the storage container 24 along the cold air pathway and air flow communication from the storage container to the source of cold air along the return air pathway, respectively. In this latter respect, the heater 65 is configured to be energized when the first air flow controlling device 54 and the second air flow controlling device 60 selectively and simultaneously close off air flow communication from the source of cold air to the storage container 24 along the cold air pathway and air flow communication from the storage container 24 to the source of cold air along the return air pathway, respectively. Three, the first air flow controlling device 54 and the second air flow controlling device 60 are configured to selectively and simultaneously close off air flow communication from the source of cold air to the storage container 24 along the cold air pathway and open air flow communication from the storage container 24 to the source of cold air along the return air pathway, respectively.

The control of the operation of the air handler as has been described above is determined at least in part by user preferences. Thus, as shown in FIG. 2, a user input panel 68 is mounted at the cover 44 of the storage compartment assembly 22, or alternatively at the housings 30 or , and the user input panel is configured to accept a user input that sets the temperature to be applied at the storage container 24. This can be done, for example, by the user inputting at the panel 68 the specific temperature that is desired or by the user inputting at the panel the type of operation that is desired to be carried out at the storage container 24, e.g., "chill drinks" or "thaw frozen meat." In the latter instance, a controller or microprocessor incorporated into an electronic control device 70 that is located in the air handler, as shown in FIG's. 4 and 5, and is operatively connected to the input panel 68, is programmed to set the temperature to be applied at the storage container 24. Also in the latter instance, the user input panel 68 can be configured to display the temperature that is to be applied and allow the user to modify that temperature if desired. The electronic control device 70 is configured to control in response to the user input selection the operation of at least the components that are configured to function in controlling the movement of air through the storage container 24. Thus, in the embodiment of the drawings, the electronic control device 70 comprises an electronic control board, or circuit board assembly, including a controller or microprocessor, that is located at the air handler and is electrically connected to the user input panel 68 and is configured to control the operation of at least the first and second air flow controlling devices 54 and 60 at the air handler at least partly in response to the user input selection. In other words, the electronic control board 70 is operatively connected to the first and second air flow controlling devices 54 and 60 through appropriate servomechanisms or the like, for example, to open and close those air flow controlling devices; to the fan 56 to turn the fan on and off; and to the heater 65 to turn the heater on and off The electronic control board 70 is also operatively connected to a temperature sensing device such as a thermistor, for example, not shown, that can be mounted to the underside of the cover 44. The controller or microprocessor at the electronic control board 70 functions to compare the actual or prevailing temperature at the storage container 24 with the temperature that has been selected at the user input panel 68, and the controller is programmed to transmit to the other components of the electronic control board 70, in response to that comparison, appropriate instructions concerning the operational control of the first and second air flow controlling devices 54 and 60, the fan 56 and the heater 65.

Referring once more to FIG. 4 of the drawings, the air handler is shown to include an air handler air exit point 72 and an air handler air entry point 74, and the storage container 24, as shown in FIG. 3, includes a storage container air entry point 76 and a storage container air exit point 78. The air handler air exit point 72 and the storage container air entry point 76 are in air flow communication with one another, and the air handler air entry point 74 and the storage container air exit point 78 are in air flow communication with one another.

Based on the foregoing description it will be understood that the embodiment of the storage compartment assembly 22 located within the fresh food compartment 12 of the refrigerator shown in the drawings includes, along with the storage container 24 and the air handler that is configured to selectively circulate air to the storage container over a range of temperatures from a temperature below the temperature of the fresh food compartment to a temperature above the temperature of the fresh food compartment, the following components and features: a first air flow path that leads from the first air flow controlling device 54 within the air handler 32, past the fan 56, through the air handler air exit point 72 and through the storage container air entry point 76 into the storage container; a second air flow path that leads from a source of cold air, such as the evaporator 84, with which the air handler is configured to be in air flow communication, through the opening 47 in the freezer compartment 14, through the mullion cold air supply duct 63, through the air handler cold air supply duct 52, to the first air flow controlling device 54, the second air flow path being joined with the first air flow path at the first air flow controlling device 54; a third air flow path that leads from the storage container air exit point 78, through the air handler air entry point 74, to within the air handler at the second air flow controlling device 60; a fourth air flow path that leads from within the air handler at the second air flow controlling device 60, through the air handler return duct 62, through the mullion air return duct 64 and the opening 61 in the freezer compartment 14 to the source of cool air, or the evaporator 84, with which the air handler is configured to be in air flow communication, the fourth air flow path being joined to the third air flow path at the second air flow controlling device 60. The air handler also includes a fifth air flow path that joins the first air flow path and the third air flow path at the first air flow controlling device 54 and the second air flow controlling device 60, respectively.

With respect to the five air flow paths described in the immediately preceding paragraph, the first air flow controlling device 54 is configured to selectively open and close the flow of air between the first air flow path and the second air flow path, and the second air flow controlling device 60 is configured to selectively open and close the flow of air between the third air flow path and the fourth air flow path. Additionally, the first air flow controlling device 54 and the second air flow controlling device 60 are configured to be selectively open at the same time to allow air from the evaporator 84 to flow to the storage container 24 along the first and second air flow paths and, after circulating in the storage container, to flow back to the evaporator along the third and fourth air flow paths. Also, the first and second air flow controlling devices 54 and 60 are configured to be selectively closed at the same time to close off the flow of air from the evaporator 84 to the storage container 24 along the first and second air flow paths and the flow of air from the storage container to the evaporator along the third and fourth air flow paths, whereby air can flow from the storage compartment air exit point 78 to the storage compartment air entry point 76 along the third, fifth and second air flow paths and in that manner circulate between the storage container 24 and the air handler. In addition, the first airflow controlling device 54 and the second air flow controlling device 60 are configured such that the first air flow controlling device is selectively closed to close off the flow of air from the evaporator 84 to the storage container 24 along the first and second air flow paths at the same time as the second air flow controlling device 60 is selectively open to allow air from the storage container to flow to the evaporator 84 along the third and fourth air flow paths.

As shown at FIG's. 4 and 5, the fan 56 that is configured to at least assist in moving the air that passes between the air handler and the storage container 24 is located adjacent the air handler air exit point 72; and the heater 65 that is configured when energized to increase the temperature of the air being circulated from the air handler to the storage container 24 is located adjacent and somewhat below the fan 56 and the first air flow path.

Additionally, as shown in FIG. 3, the storage container 24 includes a front 80 and a rear 82, that are joined by the sides 26 and 28 of the storage container, and the air handler is located at the second side 28 and externally of the storage container in that embodiment. In this arrangement, the storage container 24 is configured for withdrawal from and return to the interior 20 of the fresh food compartment 12 while the air handler, which is secured to the interior of the fresh food compartment, remains in place within the fresh food compartment. Further, the first housing 30, in which can be contained at least a component of a water filtering system, such as the filter 35 itself, is located at the first side 26 of the storage container 24 and the first housing 30 also is secured to the interior 20 of the fresh food compartment 12 so as to remain in place within the fresh food compartment when the storage container 24 is withdrawn from and returned to the interior of the fresh food compartment. While the air handler is shown in the embodiment of the drawings to be located at the second side 28 of the storage container, the air handler can be installed at other locations such as, for example, at the first side 26 of the storage container or at the rear 82 of the storage container.

The cold air generated at the evaporator 84, in addition to flowing to the air handler as described above, flows to the freezer compartment 14 and the fresh food compartment 12. An evaporator fan, not shown, is located adjacent to the evaporator 84 so as to draw air through the evaporator coils to cool the air after which the cold air flows to the three destinations referred to, as required. In the case of cold air that flows to the fresh food compartment 12, the cold air flows along a fresh food compartment air delivery pathway that is configured to deliver cold air from the area of the evaporator 84 to the fresh food compartment 12. As shown in FIG. 5, the air delivery pathway extends from the evaporator 84 through the duct 85 that is provided with suitable openings through which the cold air is distributed to the interior 20 of the food compartment 12. Air returns to the evaporator 84 from the fresh food compartment through a first fresh food compartment air return pathway and a second fresh food compartment air return pathway for returning air from the fresh food compartment to the evaporator. In the embodiment of the drawings, the first fresh food compartment air return pathway includes at least the pathway from a first fresh food air return opening, not shown, that is located at the base of the fresh food compartment 12 directly below the foot-like projection 89 that depends from the housing 30. The return air passes through the projection 89, through the first fresh food air return opening beneath the projection 89, through a fresh food air return duct 86 located in the mullion 46 and into the area of the evaporator 84 through the opening 87 located at the top of the housing 83. And the second fresh food compartment air return pathway includes at least a pathway from a second fresh food air return opening, not shown, located at the base of the fresh food compartment 12 directly below the foot-like projection 88 that depends from the housing 31. The return air passes through the projection 88, through the second fresh food compartment opening beneath the projection 88, through the mullion air return duct 64 located in the mullion 46, through the opening 61 in the evaporator housing 83 and into the area of the evaporator 84. In the case of the second fresh food compartment air return pathway, that pathway joins with the return air pathway that is configured to selectively provide air flow communication from the storage container 24 to the evaporator 84. That is, return air from the fresh food compartment passing through the foot-like projection 88 and the second fresh food compartment opening beneath the projection 88 and any air entering the mullion air return duct 64 from the air handler air return duct 62 come together in the duct 64. Both foot-like projections 88 and 89 comprise open grids through which air can pass but which prevent solid matter from entering the ducts 64 and 86, respectively.

The embodiment of the invention shown in the drawings functions as follows. When it is desired to cool articles placed in the storage container 24, the user will either input a particular target, or set, temperature into the user input panel 68 or select from the options available at the user input panel a food or drink item option such as "chill drinks" for example. Assuming that a food or drink item option has been input at the user input panel 68, a display screen at the user input panel will then display the target temperature that corresponds to that option. If the user wishes to adjust the target temperature to either a colder or warmer target temperature, that can be done. At that point, information concerning the target temperature, as it may have been adjusted, along with information concerning the temperature sensed by the thermistor located at the storage container 24 will be transmitted to the electronic control board 70. In response to a comparison of these two temperatures, and assuming that at that time or at some time thereafter the temperature at the storage container 24 is higher than the target temperature, the electronic control board will function in response to directions from the controller included with the electronic control board to cause the heater 65 to not be energized, both first and second air flow controlling devices 54 and 60, respectively, to be open and the fan 56 to operate. As a result, cold air will be drawn up into the air handler from the area of the evaporator 84 through the mullion cold air supply duct 63 and the air handler cold air supply duct 52 past first air flow controlling device 54, through fan 56, air handler air exit point 72 and storage container air entry point 76 and into the storage container 24. After circulating through the storage container, the air will exit the storage container through the storage container air exit point 78, pass into the air handler through the air handler air entry point 74 and continue past the second air flow controlling device 60 into air handler air return duct 62 and mullion air return duct 64 from where the air will be discharged to the area of the evaporator 84. In one embodiment, every ten seconds while cold air is being circulated in this way, the prevailing temperature in the storage container 24, as sensed by the thermistor, will be compared with the target temperature, as it may have been adjusted by the user. The three comparisons are averaged, and so long as the target, or set, temperature remains lower than the average of the three sensed temperatures, the circulation of the cold air continues until the target temperature is reached.

In a warming mode, the user will once again input into the user input panel 68 a particular target, or set, temperature or select from the options available at the user input panel a food or drink item option that involves warming the contents of the storage container 24 such as when an article is to be thawed. Assuming a food item option has been selected, the user input panel will display the target temperature for that option. If the user wishes to adjust the target temperature to either a colder or warmer target temperature, that can be done. At that point, information concerning the target temperature, as it may have been adjusted, will be transmitted to the electronic control board 70 along with information concerning the temperature sensed by the thermistor at the storage container. Assuming that at that time, or at some time thereafter, the temperature at the storage container 24 is lower than the target temperature, the control board will function to cause the heater 65 to be energized, the first and second air flow controlling devices 54 and 60 to be completely closed and the fan 56 to operate. As a result, cold air will not be able to be drawn up into the air handler through air handler cold air supply duct 52 nor will warm air exiting the storage container 24 through the storage container air exit point 78 and entering the air handler at air handler air entry point 74 be returned to the area of the evaporator 84. Instead, the air will simply circulate between the air handler and the storage container 24 along the third, fifth and first air flow paths described above and be warmed by the heater 65 as the air is circulated. In one embodiment, every two seconds while air is being circulated in this way, the prevailing temperature in the storage container 24, as sensed by the thermistor located there, will be compared with the target temperature and, if the target temperature is higher than the sensed temperature, the circulation of the air between the air handler and the drawer will continue until the target temperature is reached.

In a mode of operation in which it is desired, simply, that articles placed in the storage container 24 be maintained at approximately the same temperature as maintained in the fresh food compartment 12, the storage compartment assembly is placed in an idle mode such as by means of an appropriate input selection at the user input panel 68. In an idle mode, the controller at the electronic control board 70 functions to turn off both the fan 56 and the heater 65, close first air flow controlling device 54 so that cold air from the area of the evaporator 84 cannot reach the storage container 24 and open second air flow controlling device 60 so that any air flowing from the storage container 24 into the air handler through the storage container air exit point 78 and the air handler air entry point 74 can flow through the air handler air return duct 62 to the area of the evaporator 84. Because the storage container 24 is generally exposed to the environment of the fresh food compartment, the storage container will tend to be maintained at a temperature approximately the same as the temperature of the fresh food compartment.

Based on the foregoing descriptions, it will be understood that in one embodiment the present invention provides a method of controlling the temperature in the storage container 24 that is located in the fresh food compartment 12 of the refrigerator 10 comprising: selecting a temperature to be applied at the storage container; comparing the prevailing temperature in the storage container with the selected temperature; delivering to the storage container air having a lower temperature than the prevailing temperature when the selected temperature is lower than the prevailing temperature and air having a higher temperature than the prevailing temperature when the selected temperature is higher than the prevailing temperature; and exhausting from the storage container air that has circulated in the storage container. In one aspect, air having a lower temperature than the prevailing temperature is delivered to the storage container from the area of the refrigerator evaporator 84 through the first air flow controlling device that is maintained in an open position when the selected temperature is lower than the prevailing temperature and air exhausted from the storage container is directed to the area of the evaporator through the second air flow controlling device 60 that is maintained in an open position when air is delivered to the storage container from the area of the evaporator through the first air flow controlling device. According to another aspect of the method, at such time as air having a higher temperature than the prevailing temperature in the storage chamber is being delivered to the storage chamber, the first air flow controlling device and the second air flow controlling device are maintained in a closed position to close off the flow of air to and from the area of the evaporator to the storage chamber.

In another embodiment of a method of the invention, the temperature in the storage container 24 located in the fresh food compartment 12 of the refrigerator 10 is controlled by selecting a temperature to be applied at the storage container and carrying out from a group of at least three available operations an appropriate operation for applying the selected temperature at the storage container. The three available operations include: comparing the prevailing temperature in the storage container with the selected temperature and delivering to the storage container air having a lower temperature than the prevailing temperature when the selected temperature is lower than the prevailing temperature, while exhausting from the storage container air that has circulated in the storage container; comparing the prevailing temperature in the storage container with the selected temperature and delivering to the storage container air having a higher temperature than the prevailing temperature when the selected temperature is higher than the prevailing temperature while exhausting from the storage container air that has circulated in the storage container; and maintaining the storage container at substantially the same temperature as the temperature of the fresh food compartment while allowing air from the storage container to exit the storage container.

In one aspect, the available operation of delivering to the storage container 24 air having a lower temperature than the prevailing temperature when the selected temperature is lower than the prevailing temperature while exhausting from the storage container air that has circulated in the storage container includes delivering air to the storage container from the area of the evaporator 84 of the refrigerator 10 through the first air flow controlling device 54 that is maintained in an open position and exhausting air from the storage container to the area of the evaporator through the second air flow controlling device 60 that is maintained in an open position.

According to another aspect, the available operation of delivering to the storage container air 24 having a higher temperature than the prevailing temperature when the selected temperature is higher than the prevailing temperature while exhausting from the storage container air that has circulated in the storage container includes delivering air to the storage container while maintaining the first air flow controlling device 54 in a closed position so as to close off the flow of air from the area of the evaporator 84 to the storage container and exhausting air from the storage container while maintaining the second air flow controlling device 60 in a closed position so as to close off the flow of air from the storage container to the area of the evaporator. In another aspect, the available operation of delivering to the storage container air having a higher temperature than the prevailing temperature when the selected temperature is higher than the prevailing temperature while exhausting from the storage container air that has circulated in the storage container includes increasing the heat content of the air before it is delivered to the storage container.

According to a further aspect of the method, the available operation of maintaining the storage container 24 at substantially the same temperature as the temperature of the fresh food compartment while allowing air from the storage container air to exit the storage container includes maintaining the first air flow device 54 in a closed position so as to close off the flow of air from the area of the evaporator 84 to the storage container and allowing air to exit the storage container and pass to the area of the evaporator through the second air flow controlling device 60 that is maintained in an open position.

The foregoing methods and aspects thereof in which the operation carried out comprises delivering to the storage container air having a lower temperature than the prevailing temperature when the selected temperature is lower than the prevailing temperature while exhausting from the storage container air that has circulated in the storage container can involve sensing the prevailing temperature in the storage container every ten seconds, averaging three consecutive ten-second readings and comparing the average of the three readings with the prevailing temperature. And the foregoing methods and aspects thereof in which the operation carried out comprises delivering to the storage container air having a higher temperature than the prevailing temperature when the selected temperature is higher than the prevailing temperature while exhausting from the storage container air that has circulated in the storage container can involve comparing the prevailing temperature in the storage container with the selected temperature approximately every two seconds.

The methods and aspects referred to above also can include bringing together air exhausted from the storage container 24 with air exhausted from the fresh food compartment 12 upstream of the evaporator area 84 and delivering the combined air to the area of the evaporator.

Although the various embodiments of the invention have been described with reference to the first and second air flow controlling devices being entirely open when air flow is to take place from the area of the evaporator 84 to the storage container 24, on the one hand, and from the storage container to the area of the evaporator, on the other hand, the degree to which each of the first and second flow controlling devices is open in these circumstances can be varied as appropriate.

What is claimed is:

1. A refrigerator including:

a refrigerator compartment including an interior and opposing first and second interior sides, and at least one door closing off an open front of the refrigerator that is located between the opposing first and second interior sides;

a storage compartment assembly located within the interior of the refrigerator compartment between the opposing first and second interior sides of the refrigerator compartment, the storage compartment assembly including a storage container including an open top for providing access to the interior of the storage container, the storage container including a first side located opposite the first interior side of the refrigerator compartment and a second side located opposite the second interior side of the refrigerator compartment, at least one of the first side and the second side of the storage container being spaced away from the first interior side and the second interior side, respectively, of the refrigerator compartment, thereby providing a respective space between at least one of the first side of the storage container and the first interior side of the refrigerator compartment and the second side of the storage container and the second interior side of the refrigerator compartment; and at least one of the respective spaces between at least one of the first side of the storage container and the first interior side of the refrigerator compartment and the second side of the storage container and the second interior side of the refrigerator compartment including a housing, wherein the storage compartment assembly includes a cover that covers the open top of the storage container when the storage container is in place within the refrigerator compartment, the cover extending over and being supported by the housing, and wherein the storage container is configured for withdrawal from between the opposing first and second interior sides of the refrigerator compartment and from the housing located in at least one of the respective spaces between at least one of the first side of the storage container and the first interior side of the refrigerator compartment and the second side of the storage container and the second interior side of the refrigerator compartment and for reentry into the interior of the refrigerator compartment after having been withdrawn, the withdrawal and reentry of the storage container being facilitated by a rail system including a rail mounted to at least one of the first side and second side of the storage container and a complementary rail mounted to an adjacent side of the housing, whereby the storage container can be withdrawn from and returned to the interior of the refrigerator compartment along the rail system and, when withdrawn, supported from the interior of the refrigeration compartment at the rail system.

2. The refrigerator of claim 1 wherein the housing contains at least components that are configured to function in the operation of the refrigerator.

3. The refrigerator of claim 2 wherein the components that are configured to function in the operation of the refrigerator comprise at least components that are configured to function in the operation of the storage compartment assembly.

4. The refrigerator of claim 3 wherein the components that are configured to function in the operation of the storage compartment assembly comprise at least components that are configured to function in controlling the movement of air through the storage container.

5. The refrigerator of claim 4 wherein the components that are configured to function in controlling the movement of air through the storage container comprise at least components that are configured to function in controlling the movement of air through the storage container at temperatures of the air that range from a temperature below the temperature of the refrigerator compartment to a temperature above the temperature of the refrigerator compartment.

6. The refrigerator of claim 5 wherein the refrigerator compartment comprises a fresh food compartment.

7. The refrigerator of claim 6 wherein the at least one door comprises a door for opening and closing the interior of the fresh food compartment to the exterior of the fresh food compartment, the door being pivotally mounted at the same side of the fresh food compartment at which the housing is located.

8. The refrigerator of claim 6 including a freezer compartment and an evaporator located beneath the fresh food compartment.

9. The refrigerator of claim 1 wherein the housing comprises a first housing and a second housing, the first housing being located in the respective space between the first interior side of the refrigerator compartment and the first side of the storage container and the second housing being located in the respective space between the second interior side of the refrigerator compartment and the second side of the storage container, a rail system including a rail mounted to the first side of the storage container and a complementary rail mounted to an adjacent side of the first housing, and a rail mounted to the second side of the storage container and a complementary rail mounted at an adjacent side of the second housing, whereby the storage container can be withdrawn from and returned to the interior of the refrigerator compartment along the rail system and, when withdrawn, supported from the interior of the refrigeration compartment at the rail system.

10. The refrigerator of claim 9 wherein the refrigerator compartment comprises a fresh food compartment.

11. The refrigerator of claim 10 including a freezer compartment and an evaporator located beneath the fresh food compartment.

12. The refrigerator of claim 11 wherein the at least one door comprises two doors configured to open and close off the interior of the fresh food compartment to the exterior of the fresh food compartment, each door including a first side and a second side opposite the first side, the first side of each door being pivotally mounted at a respective side of the fresh food compartment and the second side of each door adjoining the second side of the other door when the two doors are in a position closing off the interior of the fresh food compartment.

13. The refrigerator of claim 12 wherein the cover that covers over the open top of the storage container when the storage container is in place within the fresh food compartment extends over and is supported by each of the first housing and the second housing.

14. The refrigerator of claim 13 wherein at least one of the first housing and the second housing contains at least components that are configured to function in the operation of the refrigerator.

15. The refrigerator of claim 14 wherein the components that are configured to function in the operation of the refrigerator comprise at least components that are configured to function in the operation of the storage compartment assembly.

16. The refrigerator of claim 15 wherein the components that are configured to function in the operation of the storage compartment assembly comprise at least components that are configured to function in controlling the movement of air through the storage container.

17. The refrigerator of claim 9 wherein the at least one door comprises two doors configured to open and close off the interior of the refrigerator compartment to the exterior of the refrigerator compartment, each door including a first side and a second side opposite the first side, the first side of each door being pivotally mounted at a respective side of the refrigerator compartment and the second side of each door adjoining the second side of the other door when the two doors are in a position closing off the interior of the refrigerator compartment.

18. The refrigerator of claim 17 including a freezer compartment and an evaporator located beneath the refrigerator compartment.

19. The refrigerator of claim 18 wherein the cover that covers over the open top of the storage container when the storage container is in place within the refrigerator compartment extends over and is supported by each of the first housing and the second housing.

20. The refrigerator of claim 9 including an evaporator located beneath the refrigerator compartment.

21. The refrigerator of claim 20 wherein the cover that covers over the open top of the storage container when the storage container is in place within the refrigerator compartment extends over and is supported by each of the first housing and the second housing.

22. The refrigerator of claim 21 wherein the refrigerator compartment comprises a fresh food compartment.

23. The refrigerator of claim 9 wherein at least one of the first housing and the second housing contains at least components that are configured to function in controlling the movement of air through the storage container at temperatures of the air that range from a temperature below the temperature of the refrigerator compartment to a temperature above the temperature of the refrigerator compartment, and at least the other of the first housing and the second housing contains at least components that are configured to function in filtering water dispensed at the refrigerator.

24. The refrigerator of claim 23 wherein the refrigerator compartment comprises a fresh food compartment.

25. The refrigerator of claim 24 including a freezer compartment and an evaporator located beneath the fresh food compartment.

26. The refrigerator of claim 25 wherein the at least one door comprises two doors configured to open and close off the interior of the fresh food compartment to the exterior of the fresh food compartment, each door including a first side and a second side opposite the first side, the first side of each door being pivotally mounted at a respective side of the fresh food compartment and the second side of each door adjoining the second side of the other door when the two doors are in a position closing off the interior of the fresh food compartment.

27. The refrigerator of claim 26 wherein the cover that covers over the open top of the storage container when the storage container is in place within the fresh food compartment extends over and is supported by each of the first housing and the second housing.

28. The refrigerator of claim 27 including a user input panel mounted at one of the cover and one of the first housing and the second housing, the user input panel being configured to accept user inputs and being operatively connected to an electronic control device that is configured to control at least in response to the user inputs the operation of at least the components that are configured to function in controlling the movement of air through the storage container.

29. The refrigerator of claim 9 wherein one of the first housing and the second housing contains at least components that are configured to function in controlling the movement of air through the storage container along a cold air pathway configured to selectively provide air flow communication from a source of cold air to the storage container and along a return air pathway configured to selectively provide air flow communication from the storage container to the source of cold air.

30. The refrigerator of claim 29 wherein the components that are configured to function in controlling the movement of air through the storage container include a first air flow controlling device configured to selectively open and close off air flow communication from the source of cold air to the storage container along the cold air pathway and a second air flow controlling device configured to selectively open and close off air flow communication from the storage container to the source of cold air along the return air pathway.

31. The refrigerator of claim 30 wherein the components that are configured to function in controlling the movement of air through the storage container include a fan located in the cold air pathway that is configured to move air from the air handler to the storage container.

32. The refrigerator of claim 31 wherein the a heater configured to selectively increase the temperature of air moving from the air handler to the storage container.

33. The refrigerator of claim 32 wherein the first air flow controlling device and the second air flow controlling device are configured to selectively simultaneously open air flow communication from the source of cold air to the storage container along the cold air pathway and air flow communication from the storage container to the source of cold air along the return air pathway, respectively, and selectively simultaneously close off air flow communication from the source of cold air to the storage container along the cold air pathway and air flow communication from the storage container to the source of cold air along the return air pathway, respectively.

34. The refrigerator of claim 33 wherein the first air flow controlling device and the second air flow controlling device are configured to selectively simultaneously close off air flow communication from the source of cold air to the storage container along the cold air pathway and open air flow communication from the storage container to the source of cold air along the return air pathway, respectively.

35. The refrigerator of claim 34 wherein the heater is configured to be energized when the first air flow controlling device and the second air flow controlling selectively simultaneously close off air flow communication from the source of cold air to the storage container along the cold air pathway and air flow communication from the storage container to the source of cold air along the return air pathway, respectively.

36. The refrigerator of claim 35 wherein the storage container includes an open top and the storage compartment assembly includes a cover that covers over the open top of the storage container when the storage container is in place within the fresh food compartment, and a user input panel is mounted at one of the cover, the first housing and the second housing, the user input panel being configured to accept user inputs and being operatively connected to an electronic control device that is configured to control at least in response to the user inputs the operation of at least the components that are configured to function in controlling the movement of air through the storage container.

37. The refrigerator of claim 36 wherein the electronic control device comprises an electronic control board that is located in the air handler.

38. The refrigerator of claim 13 wherein one of the first housing and the second housing includes at least components that are configured to function in controlling the movement of air through the storage container along a cold air pathway configured to selectively provide air flow communication from the evaporator to the storage container and along a return air pathway configured to selectively provide air flow communication from the storage container to the evaporator.

39. The refrigerator of claim 38 wherein the components that are configured to function in controlling the movement of air through the storage container include a first air flow controlling device configured to selectively open and close off air flow communication from the evaporator to the storage container along the cold air pathway and a second air flow controlling device configured to selectively open and close off air flow communication from the storage container to the evaporator along the return air pathway.

40. The refrigerator of claim 39 wherein the components that are configured to function in controlling the movement of air through the storage container include a fan located in the cold air pathway and configured to move air from the air handler to the storage container.

41. The refrigerator of claim 40 wherein one of the first housing and the second housing that contains at least components that are configured to function in controlling the movement of air through the storage container also contains a heater configured to selectively increase the temperature of air moving from the air handler to the storage container.

42. The refrigerator of claim 41 wherein the first air flow controlling device and the second air flow controlling device are configured to selectively simultaneously open air flow communication from the evaporator to the storage container along the cold air pathway and air flow communication from the storage container to the evaporator along the return air pathway, respectively, and selectively simultaneously close off air flow communication from the evaporator to the storage container along the cold air pathway and air flow communication from the storage container to the evaporator along the return air pathway, respectively.

43. The refrigerator of claim 42 wherein the first air flow controlling device and the second air flow controlling device are configured to selectively simultaneously close off air flow communication from the evaporator to the storage container along the cold air pathway and open air flow communication from the storage container to the evaporator along the return air pathway, respectively.

44. The refrigerator of claim 43 wherein the heater is configured to be energized when the first air flow controlling device and the second air flow controlling device selectively simultaneously close off air flow communication from the evaporator to the storage container along the cold air pathway and air flow communication from the storage container to the evaporator along the return air pathway, respectively.

45. The refrigerator of claim 44 including a user input panel mounted at one of the cover, the first housing and the second housing, the user input panel being configured to accept user inputs and being operatively connected to an electronic control device that is configured to control at least in response to the user inputs the operation of at least the components included in the air handler that are configured to function in controlling the movement of air through the storage container.

46. The refrigerator of claim 45 wherein the electronic control device comprises an electronic control board that is located in the air handler.

47. The refrigerator of claim 46 including a fresh food compartment air delivery pathway configured to deliver cold air from the evaporator to the fresh food compartment and at least one first fresh food compartment air return pathway for returning air from the fresh food compartment to the evaporator.

48. The refrigerator of claim 47 including a second fresh food compartment air return pathway for returning air from the fresh food compartment to the evaporator.

49. The refrigerator of claim 48 wherein the second fresh food compartment air return pathway joins with the return air pathway configured to selectively provide air flow communication from the storage container to the evaporator.

* * * * *